US007621284B2

(12) United States Patent
Hedstrom et al.

(10) Patent No.: US 7,621,284 B2
(45) Date of Patent: Nov. 24, 2009

(54) PRESSURE RELIEF SYSTEM FOR A DISHWASHER PUMP ASSEMBLY

(75) Inventors: Kristen K. Hedstrom, Orlando, FL (US); Mark E. Palm, Orlando, FL (US)

(73) Assignee: Maytag Corporation, Benton Harbor, MI (US)

( * ) Notice: Subject to any disclaimer, the term of this patent is extended or adjusted under 35 U.S.C. 154(b) by 639 days.

(21) Appl. No.: 11/052,989

(22) Filed: Feb. 9, 2005

(65) Prior Publication Data

US 2006/0174917 A1 Aug. 10, 2006

(51) Int. Cl.
*A47L 15/46* (2006.01)
*B08B 3/00* (2006.01)
*B08B 7/04* (2006.01)

(52) U.S. Cl. ..... 134/58 D; 134/18

(58) Field of Classification Search ..... 134/111, 134/10, 25.2, 22.1, 22.11, 22.12, 22.18, 34, 134/56 R, 57 R, 58 R, 57 D, 57 DL, 56 D, 134/58 D, 58 DL
See application file for complete search history.

(56) References Cited

U.S. PATENT DOCUMENTS 2,621,666 A * 12/1952 Hior Ornas ..... 134/57 R
5,167,248 A 12/1992 Tuller
5,320,120 A * 6/1994 Hoffman et al. ..... 134/104.1
5,601,660 A * 2/1997 Jeon et al. ..... 134/10
5,743,281 A * 4/1998 Sargeant et al. ..... 134/57 D
5,762,080 A 6/1998 Edwards et al.
5,909,743 A 6/1999 Thies et al.
6,103,017 A 8/2000 Thies et al.
6,182,674 B1 2/2001 Jozwiak et al.
6,418,943 B1 7/2002 Miller
6,432,216 B1 8/2002 Thies
6,811,617 B2 * 11/2004 Elick et al. ..... 134/10
2004/0003830 A1 * 1/2004 Elick et al. ..... 134/10

FOREIGN PATENT DOCUMENTS

JP 60-110308 * 6/1985
JP 63-91110 * 4/1988

* cited by examiner

*Primary Examiner*—Michael Kornakov
*Assistant Examiner*—Stephen Ko
(74) *Attorney, Agent, or Firm*—John W. Morrison; Dierdericks & Whitelaw PLC

(57) ABSTRACT

A dishwasher includes a filter chamber having a pressure relief system. The filter chamber preferably includes two drain ports, a first that leads to a drain line through a drain pump, and a second that leads directly to the drain line for over-pressure relief. The drain line is formed with a loop that establishes a pressure head. In the event that the filter chamber becomes clogged, a pressure build-up will occur. If the pressure in the filter chamber exceeds the pressure head in the drain line, a siphoning action will be automatically triggered that evacuates the washing fluid from the filter chamber. In this manner, the filter chamber can be purged through operation of the drain pump or, in the event of a clog resulting in an over-pressure condition, by siphoning the wash fluid directly into the drain line.

30 Claims, 3 Drawing Sheets

PRESSURE RELIEF SYSTEM FOR A DISHWASHER PUMP ASSEMBLY

BACKGROUND OF THE INVENTION

1. Field of the Invention

The present invention pertains to the art of dishwashers and, more particularly, to a pressure relief system for a filter chamber portion of a dishwasher pump assembly.

2. Discussion of the Prior Art

In a typical dishwasher, washing fluid is pumped from a sump into upper and lower wash arms such that kitchenware retained on vertically spaced racks within a tub of the dishwasher will be sprayed with the washing fluid for cleaning purposes. The washing fluid is recirculated through operation of a wash pump. Prior to recirculating the washing fluid, the fluid is directed through one or more filters to remove soil from the fluid, with the soil being collected in a chamber. Periodically, the system will be purged in order to drain the chamber of the soil.

Despite the periodic purging of the system, the filter chamber can become prematurely clogged. That is, if a large amount of soil becomes entrained in the washing fluid, the soil can clog a filter screen portion of the filter chamber. In recognition of this problem, manufacturers have developed several systems designed to prevent the filter from becoming clogged. One proposed solution is a backflush system wherein a spray of washing fluid, typically from the lower wash arm, is directed downward onto the filter. The spray of washing fluid passes through the filter, in a direction opposite to a flow of cleansed washing fluid exiting the filter, to wash away soil particles blocking the filter openings.

Another proposed solution includes placing a pressure sensor in the filter chamber. In the event the filter becomes clogged, pressure will begin to rise in the filter chamber. Sensing the rise in pressure, the pressure sensor will trigger a drain operation by activating a drain pump directly connected to the filter chamber to remove all the washing fluid from the filter chamber. While effective at alleviating a clogged filter, operating the drain pump increases an overall noise output by the dishwasher. Today's consumers are demanding quieter appliances. Repeated or excessive operation of the drain pump will not meet the demands of these consumers. In addition, incorporating a pressure sensor into the filter chamber necessarily provides an additional failure point in the system. That is, if the sensor fails, the filter chamber could remain clogged during an entire, or at least a substantial portion of, a wash cycle. If this occurs, dishes will not be properly cleaned and the consumer will feel disappointed in the quality of the product.

Therefore, despite the existence of pressure relief systems in the prior art, there still exists a need for an enhanced pressure relief system for a filter chamber employed in a dishwasher pump assembly. More specifically, there exists a need for a pressure relief system that alleviates an over pressure condition in a filter chamber without increasing an overall noise output of the appliance.

SUMMARY OF THE INVENTION

The present invention is directed to a pressure relief system for a dishwasher pump assembly. More specifically, the dishwasher includes a tub having a bottom and a plurality of side walls that collectively define a wash chamber. A sump is arranged at the bottom wall of the wash chamber and is provided with a pump assembly. The pump assembly includes a recirculation pump which establishes a flow of washing fluid in the wash chamber that is directed upon dishware and the like undergoing a washing operation. In addition to the recirculation pump, a drain line is connected to the sump to provide a path for discharging washing fluid to a drain. The drain line includes a drain loop that establishes a pressure head and, in a manner known in the art, prevents fluids from the drain from backing up into the sump.

A portion of the flow of washing fluid recirculating in the wash chamber is passed through a filter chamber which functions to remove foreign particles from the washing fluid. In accordance with the invention, the filter chamber is provided with an inlet port for receiving the flow of washing fluid and an drain port that leads directly to the drain line. With this arrangement, in the event of a clog, pressure will rise in the filter chamber. If the pressure exceeds the pressure head in the drain loop, a siphon action will be automatically triggered, thereby evacuating the washing fluid and particles from the filter chamber.

In further accordance with the invention, the pump assembly includes a drain pump, while the filter chamber is provided with a first drain port that leads into the drain pump and a second drain port that leads directly to the drain line. In this manner, the drain pump can be operated so as to perform periodic drain operations to purge the filter chamber. By incorporating the second drain port, the filter chamber can be evacuated in the event of a clog, without requiring operation of the drain pump.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
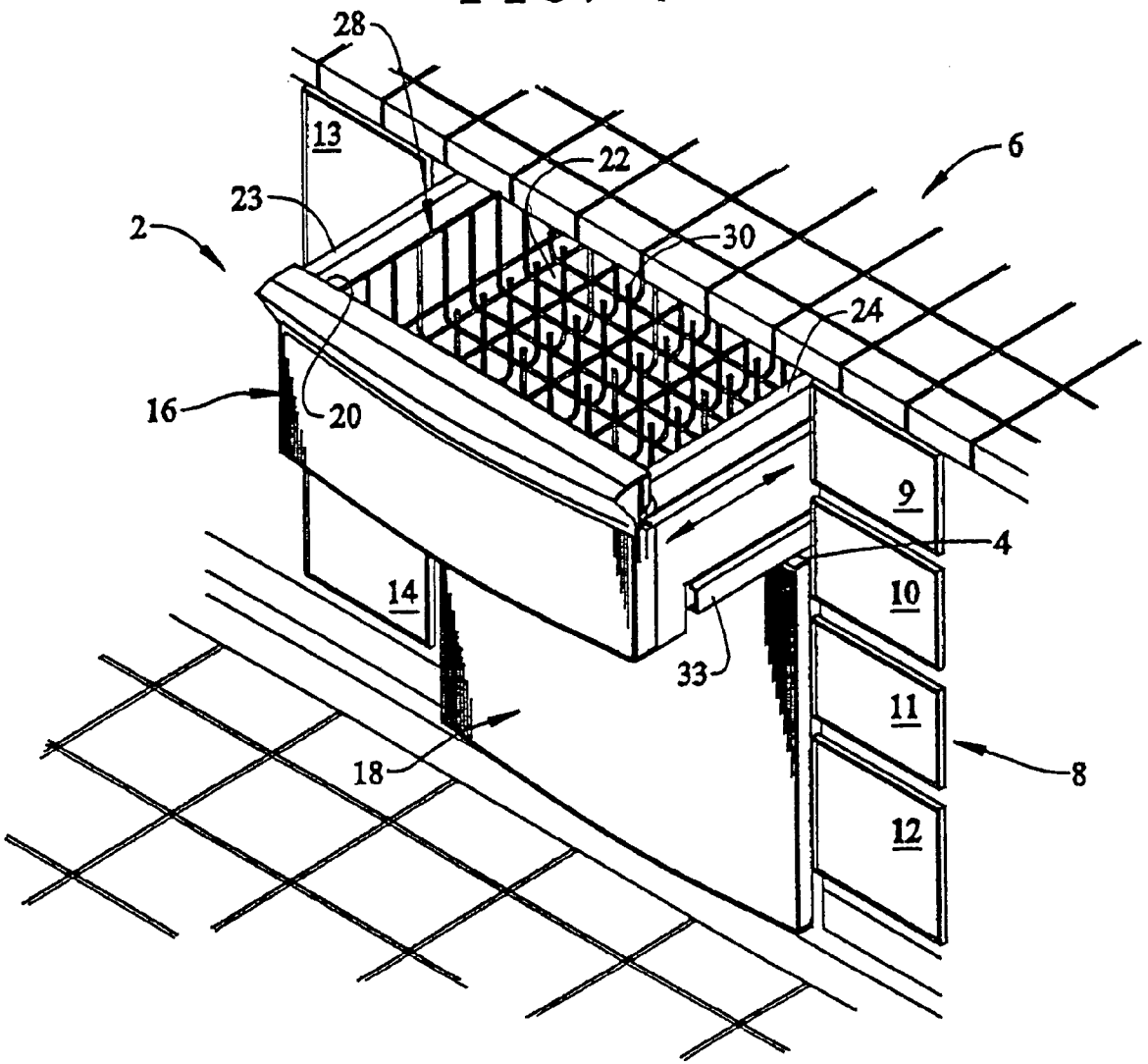
FIG. 1 is an upper right perspective view of a drawer-type dishwasher having a pump assembly provided with a pressure relief system constructed in accordance with the present invention.
Figure 2:
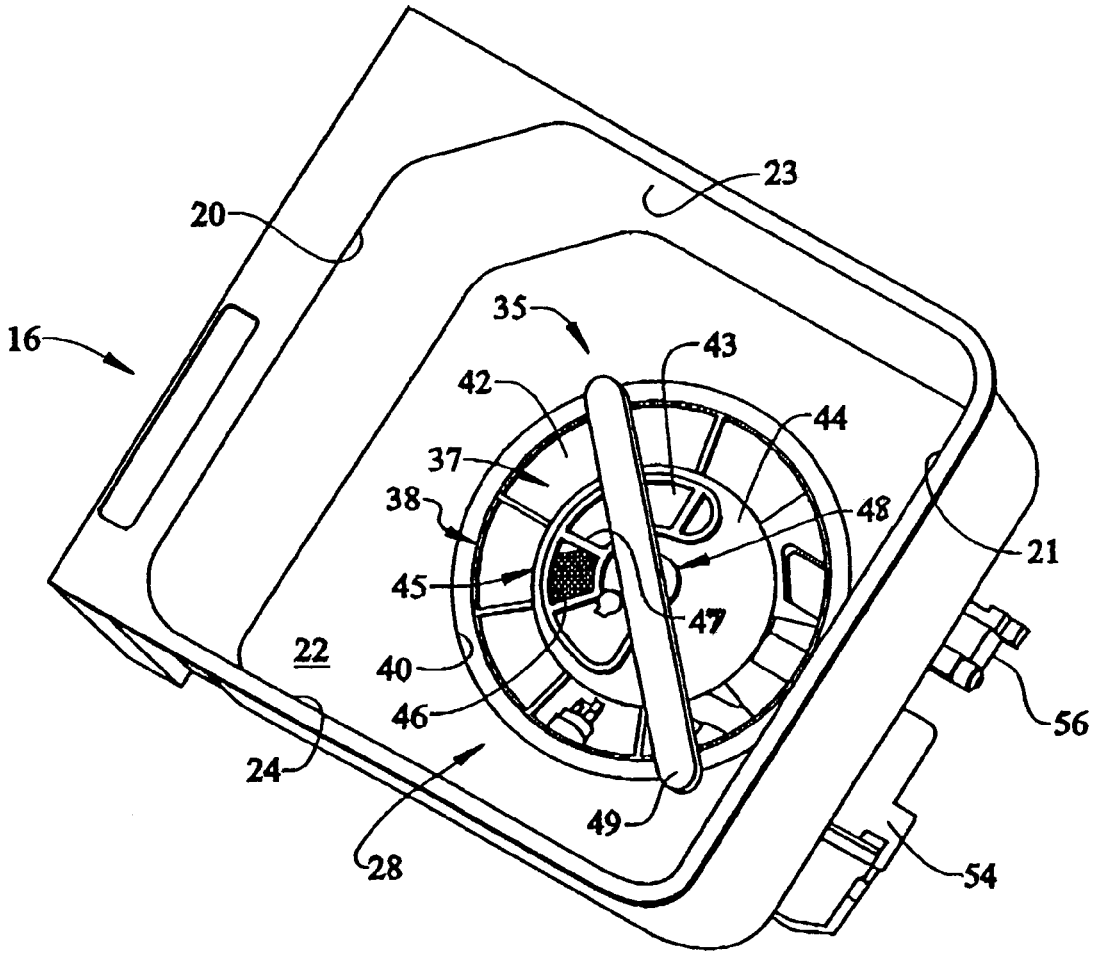
FIG. 2 is an upper perspective view of a wash tub of the dishwasher of FIG. 1.

With initial reference to FIGS. 1 and 2, a dishwasher constructed in accordance with the present invention is generally indicated at 2. As shown, dishwasher 2 includes a support frame 4 arranged below a kitchen countertop 6. Also below kitchen countertop 6 is shown cabinetry 8 including a plurality of drawers 9-12, as well as cabinet doors 13 and 14. Although the actual dishwasher into which the present invention may be incorporated can vary, the invention is shown in connection with dishwasher 2 depicted as a dual cavity dishwasher having an upper washing unit 16 and a lower washing unit 18. As best illustrated in FIG. 1, upper washing unit 16 takes the form of a slide-out drawer unit, while lower cavity 18 is illustrated as a conventional-type dishwasher. However it should be understood that both upper and lower washing units 16 and 18 could be of the slide-out drawer type.

In accordance with a preferred form of the invention, upper washing unit or drawer 16 is shown to include a front wall 20, a rear wall 21, a bottom wall 22 and opposing side walls 23 and 24 that collectively define an upper wash chamber or tub 28. In a manner known in the art, upper wash tub 28 is provided with a dish rack 30 for supporting various objects, such as dishware, glassware, and the like, that are exposed to a washing operation. Upper washing unit 16 is slidingly supported within support frame 4 through a pair of drawer support guides, one of which is indicated at 33.

As best shown in FIG. 2, a sump 35 is provided on bottom wall 22 of wash tub 28. Arranged within sump 35 is a pump assembly 37 including a main filter housing 38. Main filter housing 38 is actually positioned within a central, generally U-shaped intake ring 40 formed in bottom wall 22. In any event, main filter housing 38 includes an outer or first radial strainer 42, an inner or second radial strainer 43 and a cover 44. Actually, second radial strainer 43 defines a filter chamber 45 including a fine mesh filter screen, which is shown in part at 46 for clarity of the drawings, provided within each of a plurality of openings 47 arranged about cover 44. A hub member 48 is arranged centrally in cover 44 and serves as a support for a rotatable wash arm 49. In a manner known in the art, wash arm 49 functions to direct a flow of washing fluid onto kitchenware placed on rack 30 within wash tub 28.

Figure 3:
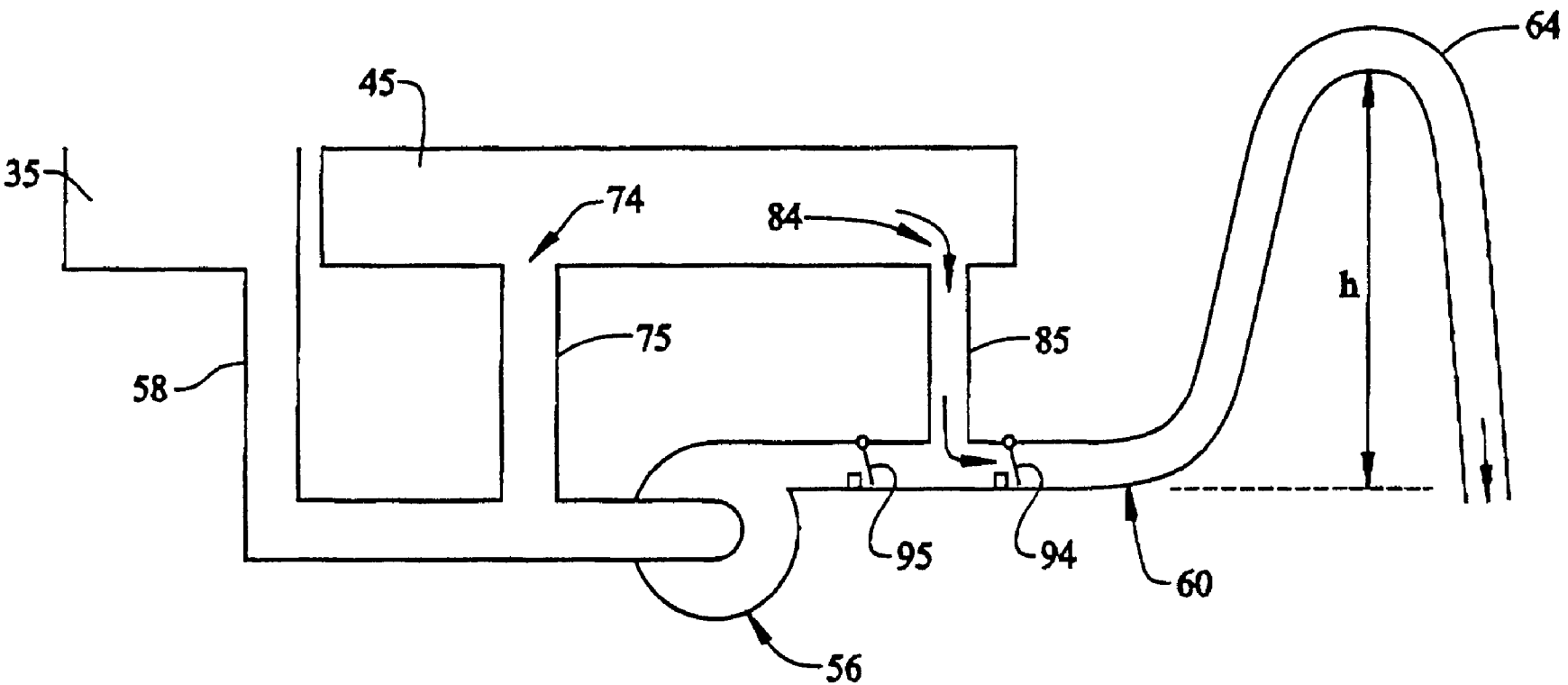
FIG. 3 is a schematic view of the pressure relief system of the present invention.

In accordance with the embodiment shown, pump assembly 37 also includes a recirculation pump 54 for establishing a recirculating flow of washing fluid. The recirculating flow of wash fluid is primarily directed to wash arm 49, with a portion of the wash fluid being guided to filter chamber 45 in order to be cleansed by passing out through fine mesh filter screen 46. The particular filtering arrangement is best set forth in commonly assigned U.S. patent application Ser. No. 11/052,862 filed Feb. 9, 2005 entitled "Pump and Filter System for a Drawer-Type Dishwasher" which is incorporated herein by reference. Pump assembly 37 further includes a drain pump 56 which fractions to discharge washing fluid and soil particles from sump 35 through a drain passage 58 (FIG. 3). Actually, drain passage 58 leads to a drain line 60 through drain pump 56. In turn, drain line 60 leads to a main household drain (not shown). Drain line 60 is provided with a drain loop 64 having a height h that maintains a pressure head in drain line 60.

With particular reference to FIG. 3, filter chamber 45 includes a first drain port 74 that leads to drain passage 58 through a first discharge passage 75. With this arrangement, activating drain pump 56 to withdraw washing fluid from sump 35 concurrently withdraws washing fluid and collected particles from within filter chamber 45. More specifically, during each drain operation, both sump 35 and filter chamber 45 are simultaneously purged of washing fluid. In accordance with the most preferred form of the invention, filter chamber 45 is provided with a second drain port 84 that leads directly into drain line 60 through a second discharge passage 85 that completely bypasses drain pump 56. Second drain port 84 serves as a pressure relief mechanism for filter chamber 45. Specifically, in the event that fine mesh screen 46 becomes clogged, a pressure will develop within filter chamber 45. When the pressure within filter chamber 45 increases to a point that exceeds the pressure head maintained drain line 60, a siphoning action is automatically triggered which causes the washing fluid and particles to be withdrawn from filter chamber 45 and directed straight to drain line 60, bypassing drain pump 56.

In still further accordance with the present invention, a one-way valve 94 is positioned within drain line 60, downstream of second discharge passage 85. Valve 94 prevents drain fluid from backflowing into filter chamber 45 from drain line 60. In addition, a second one-way valve 95 is preferably provided in drain line 60 between second discharge passage 85 and drain pump 56. Valve 95 prevents washing fluid from flowing from filter chamber 45, through passage 85 and drain pump 56, and into first drain passage 58. Thus, each of valves 94 and 95 is constituted by a one-way check valve, preferably a flapper valve, and allows a flow of washing fluid in only one direction.

Based on the above, it should be understood that the pressure release system of the present invention ensures that a pressure build up within filter chamber 45 resulting from clogging of filter screen 46 will be alleviated without having to operate drain pump 56. In this manner, the overall sound produced by dishwasher 2 can be kept at minimal levels, while a high energy efficiency for dishwasher 2 can be maintained. Although described with reference to a preferred embodiment of the present invention, it should be readily apparent to one of ordinary skill in the art that various changes and/or modifications can be made to the invention without departing from the spirit thereof. For instance, while shown in connection with a drawer type dishwasher, the pressure relief system could be employed in other models. In general, the invention is only intended to be limited by the scope of the following claims.

We claim:

1. A dishwasher comprising:

a tub having a bottom and a plurality of side walls that collectively define a wash chamber, said wash chamber establishing a sump;

a pump fluidly connected to the sump for establishing a flow of washing fluid in the wash chamber;

a drain line fluidly connected to the sump for selectively discharging washing fluid from the wash chamber, said drain line including a drain loop that establishes a pressure head;

a drain pump fluidly connected to the sump through a drain passage, said drain pump performing a purging operation to withdraw fluid from the tub during a wash cycle; and a filter chamber provided on the tub for filtering washing fluid and collecting particles, said filter chamber including a first drain port leading to the drain pump and a second drain port in direct fluid communication with the drain line, said drain passage, the first drain port and the second drain port being fluidly arranged in parallel, wherein a pressure build-up in the filter chamber that exceeds the pressure head automatically triggers a siphoning action that draws washing fluid and particles from a lower portion of the filter chamber through the second drain port and into the drain line while bypassing the drain pump.

2. The dishwasher according to claim 1, further comprising: a valve positioned between the second drain port and the drain loop, said valve preventing washing fluid in the drain line from entering the filter chamber through the second drain port.

3. The dishwasher according to claim 2, wherein the valve is constituted by a one-way valve.

4. The dishwasher according to claim 3, wherein the valve is constituted by a flapper valve.

5. The dishwasher according to claim 1, wherein said drain pump withdraws washing fluid from each of the wash chamber and the filter chamber during a purging operation.

6. The dishwasher according to claim 5, further comprising: a valve located downstream of the drain pump and upstream of the second drain port in the drain line, said valve preventing washing fluid from entering the drain pump from the filter chamber through the second drain port.

7. The dishwasher according to claim 6, wherein the valve constitutes a one-way valve.

8. The dishwasher according to claim 7, wherein the valve is constituted by a flapper valve.

9. The dishwasher according to claim 6, further comprising: another valve positioned between the second drain port and the drain loop, said another valve preventing washing fluid in the drain line from entering the filter chamber through the second drain port.

10. The dishwasher according to claim 9, wherein the another valve is constituted by a one-way valve.

11. The dishwasher according to claim 1, wherein the dishwasher is a drawer-type dishwasher.

12. The dishwasher according to claim 11, further comprising:

a first discharge passage, separate from the drain passage, leading from the first drain port of the filter chamber to the drain line through the drain pump; and a second discharge passage leading from the second drain port of the filter chamber to the drain line, while bypassing the drain pump.

13. A dishwasher comprising:

a tub having a bottom and a plurality of side walls that collectively define a wash chamber, said wash chamber establishing a sump;

a recirculation pump fluidly connected to the sump for establishing a flow of washing fluid in the wash chamber;

a drain pump fluidly connected to the sump for selectively purging washing fluid from the wash chamber;

a drain line fluidly connected to the drain pump, said drain line including a drain loop that establishes a pressure head;

a filter chamber provided on the tub for filtering the washing fluid and collecting particles;

a first drain means fluidly connected to the filter chamber, said first drain means directing the particles from the filter chamber, through the drain pump and into the drain line;

a second drain means fluidly connected to a lower portion of the filter chamber, said second drain means directing the particles from the filter chamber directly to the drain line, while bypassing the drain pump, when a pressure in the filter chamber exceeds the pressure head in the drain loop; and a third drain means, separate from the first drain means, fluidly connected between the sump and the drain pump.

14. The dishwasher according to claim 13, wherein the second drain means includes a drain port leading from the filter chamber, said drain port being in direct fluid communication with the drain line.

15. The dishwasher according to claim 14, further comprising: a valve positioned between the drain port and the drain loop, said valve preventing washing fluid in the drain line from entering the filter chamber through the drain port.

16. The dishwasher according to claim 15, wherein the valve is constituted by a one-way valve.

17. The dishwasher according to claim 16, wherein the valve is constituted by a flapper valve.

18. The dishwasher according to claim 13, wherein said first drain means includes a first discharge passage leading from the filter chamber to the drain pump, said drain pump withdrawing washing fluid from each of the wash chamber and the filter chamber during a purging operation.

19. The dishwasher according to claim 14, further comprising: a valve located in the drain line downstream of the drain pump and upstream of the drain port, said valve preventing washing fluid from entering the drain pump from the filter chamber through the drain port.

20. The dishwasher according to claim 19, wherein the valve constitutes a one-way valve.

21. The dishwasher according to claim 20, wherein said valve constitutes a flapper valve.

22. The dishwasher according to claim 19, wherein the second drain means includes a second discharge passage leading from the filter chanter, said second discharge passage being in direct fluid communication with the drain line.

23. The dishwasher according to claim 22, further comprising: another valve positioned between the second drainage passage and the drain loop, said another valve preventing washing fluid in the drain line from entering the filter chamber through the second drainage passage.

24. The dishwasher according to claim 23, wherein the another valve is constituted by a one-way valve.

25. The dishwasher according to claim 24, wherein the another valve is constituted by a flapper valve.

26. The dishwasher according to claim 13, wherein the dishwasher is a drawer-type dishwasher.

27. A method of draining a filter chamber in a dishwasher having a drain line provided with a drain loop that establishes a pressure head in the drain line comprising:

pumping a recirculating flow of washing fluid into a wash chamber;

filtering the flow of washing fluid;

collecting particles filtered from the flow of washing fluid in a filter chamber; and removing the particles from the filter chamber by:

a) draining the particles from the filter chamber, through a drain pump, wherein the particles are directed into a drain line; and b) purging particles from a lower portion of the filter chamber directly to the drain line, while bypassing the drain pump, when a pressure in the filter chamber exceeds the pressure head in the drain line.

28. The method of claim 27, further comprising: preventing a backflow of particles into the filter chamber by arranging a valve between the drain loop and the filter chamber.

29. The method of claim 27, further comprising: draining through a first drain passage that leads from the drain pump through first and second one-way valves into the drain line.

30. The method of claim 27, wherein purging particles from the filter chamber directly to the drain line, while bypassing the drain pump, is performed through an automatic siphoning operation.

* * * * *

UNITED STATES PATENT AND TRADEMARK OFFICE

CERTIFICATE OF CORRECTION

PATENT NO. : 7,621,284 B2
APPLICATION NO. : 11/052989
DATED : November 24, 2009
INVENTOR(S) : Hedstrom et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1293 days.

Signed and Sealed this

Twenty-sixth Day of October, 2010

David J. Kappos

David J. Kappos
*Director of the United States Patent and Trademark Office*